US006334043B1

(12) United States Patent
Imamura

(10) Patent No.: US 6,334,043 B1
(45) Date of Patent: Dec. 25, 2001

(54) AUTOMATIC DOCUMENT-FEEDING APPARATUS

(75) Inventor: Takao Imamura, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/521,955

(22) Filed: Mar. 9, 2000

(51) Int. Cl.[7] ..... G03G 15/00
(52) U.S. Cl. ..... 399/367
(58) Field of Search ..... 399/367, 371, 399/372, 373, 17

(56) References Cited

U.S. PATENT DOCUMENTS

| | | | | |
|---|---|---|---|---|
| 4,674,862 | * | 6/1987 | Abuyama | 399/17 |
| 5,323,219 | * | 6/1994 | Hamanaka et al. | 399/371 |
| 5,515,153 | | 5/1996 | Tokunoh . | |
| 5,576,823 | * | 11/1996 | Kakuta et al. | 399/367 |
| 5,923,941 | * | 7/1999 | Harada et al. | 399/367 X |

FOREIGN PATENT DOCUMENTS 1-85342 6/1989 (JP) .

7-291464 11/1995 (JP) .

* cited by examiner

*Primary Examiner*—Sandra Brase
(74) *Attorney, Agent, or Firm*—Foley & Lardner

(57) ABSTRACT

An automatic document feeding apparatus comprises a document rest for allowing a document to be placed thereon, a conveying belt for conveying the document onto the document rest, an urging roller for urging the conveying belt toward the document rest, a retaining member for retaining the urging roller, a support member for supporting the retaining members in a way to be slidable in a direction intersecting with the conveying direction of the document, a projection provided at one end of the retaining member, a slider mounted on the support member to slide along a conveying direction of the document, an oblique guide hole formed in the slider in a way to be made oblique with respect to the slide direction and slidably inserting the projection of the retaining member therein, and moving means which, by causing the slider to slide in the conveying direction of the document, moves the projection of the retaining member along the oblique guide hole to allow the urging roller to move in a direction intersecting with the conveying direction of the document.

5 Claims, 5 Drawing Sheets

AUTOMATIC DOCUMENT-FEEDING APPARATUS

BACKGROUND OF THE INVENTION

The present invention relates to an automatic document feeding apparatus for automatically feeding a document used for, for example, an electrophotographic type copier to a document glass.

As this type of automatic document feeding apparatus, a type is known by which a document is fed to a document glass by the running of a conveying belt. In this automatic document feeding apparatus, in order to impart an enhanced conveying capability to the document, the conveying belt is urged by urging rollers from its inner side toward the document glass.

In the conventional apparatus, since the urging roller is fixedly arranged at all times in a predetermined position, a band-like contact mark is formed at the same area on the conveying belt in a manner to correspond to a width dimension of the urging roller. And the dirty spot, wear, etc., are locally concentrated on the conveying belt at that place.

This necessitates the cleaning of the cleaning belt or frequent exchange of conveying belts. And more time and labor and more cost are required in these operations, thus posing a problem.

BRFIEF SUMMARY OF THE INVENTION

It is accordingly the object of the present invention to provide an automatic document feeding apparatus which can urge a conveying belt by urging rollers without locally concentrating a smudge, wear, etc., on the conveying belt.

An automatic document feeding apparatus of the present invention comprises a document rest for allowing a document to be placed thereon, a conveying belt for conveying the document onto the document rest, urging rollers for urging the conveying belt toward the document rest, and moving means for moving the urging roller in a direction intersecting with the document conveying direction.

An automatic document feeding apparatus of the present invention comprises a document rest for allowing a document to be placed thereon, a conveying belt for conveying the document onto the document rest, urging rollers for urging the conveying belt toward the document rest, a retaining member for retaining the urging roller, a supporting member for supporting the retaining member in a way to be slidable in a direction intersecting with the conveying direction of the document, and moving means for moving the retaining member to allow the urging roller to be moved.

An automatic document feeding apparatus of the present invention comprises a document rest for allowing a document to be placed thereon, a conveying belt for conveying the document onto the document rest, an urging roller for urging the conveying belt toward the document rest, a retaining member for retaining the urging roller, a support member for supporting the retaining member in a way to be slidable in a direction intersecting with the conveying direction of the document, a projection provided at one end of the retaining member, a slider mounted on the support member to slide along the conveying direction of the document, an oblique guide hole formed in the slider in a way to be made oblique with respect to the slide direction and slidably inserting the projection of the retaining member therein, and moving means which, by causing the slider to slide in the conveying direction of the document, moves the projection of the retaining member along the oblique guide hole to allow the urging member to be moved in a direction intersecting with the conveying direction of the document.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained below with reference to the accompanying drawing.

Figure 1:
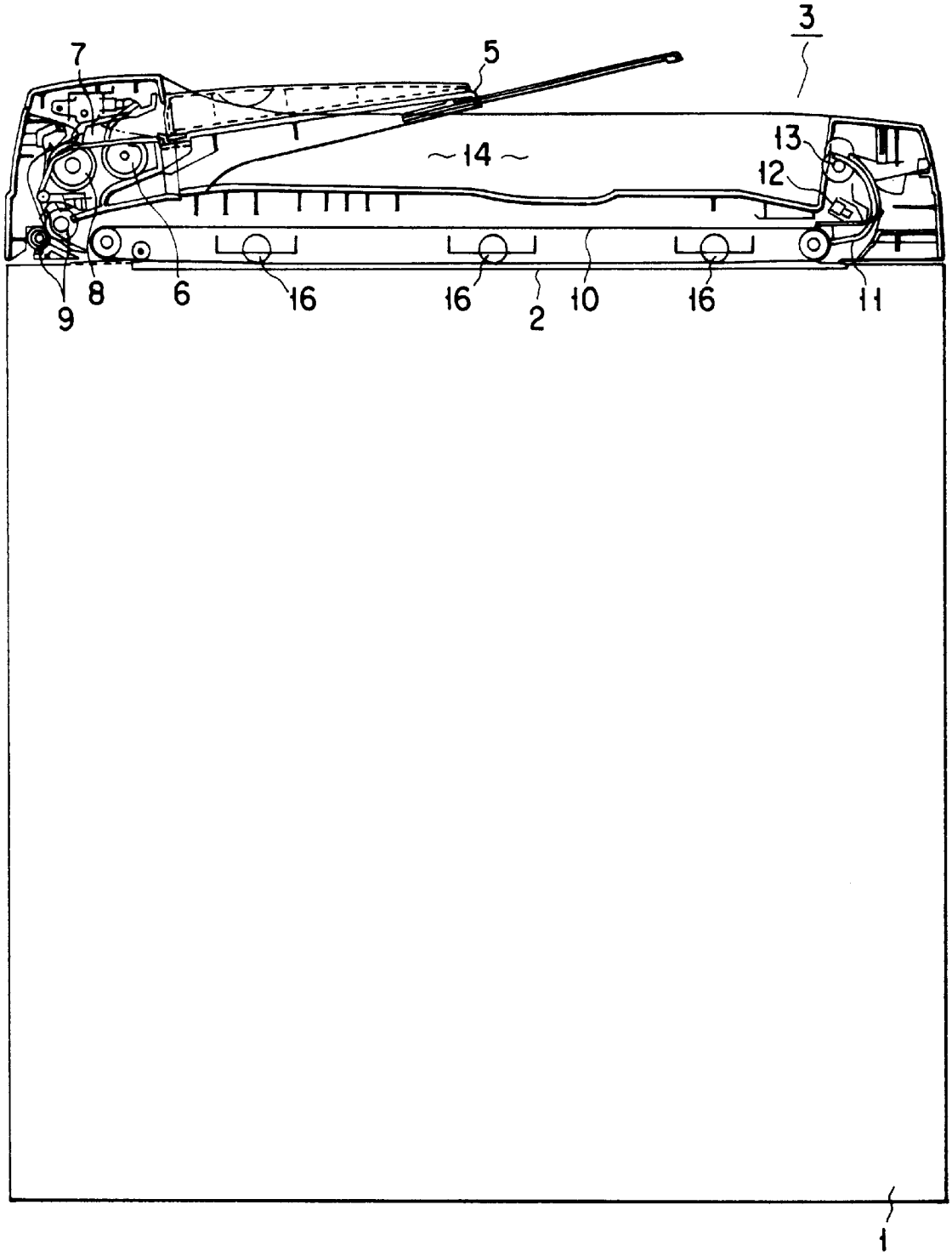
FIG. 1 is a front view showing an electrophotographic type copier equipped with an automatic document feeding apparatus according to a first embodiment of the present invention.

FIG. 1 shows an electrophotographic copier. Reference numeral 1 in FIG. 1 shows a body of the copier. At the upper surface section of the body 1 a document glass 2 is provided as a document rest.

An automatic document feeding apparatus 3 is provided on a document glass 2 to automatically feed a document sheet onto the document glass 2. The automatic document feeding apparatus 3 includes a document sheet supply rest 5 on which document sheets are set. The document sheet set on the document sheet supply rest 5 is picked up by a pick-up roller 6 and conveyed along a supplying system conveying path 7. At the supplying system conveying path 7, a sheet supply roller 8 for supplying the document sheets one by one and aligning rollers for arraying the supplied document sheet are arranged sequentially along the conveying direction of the document.

The automatic document feeding apparatus 3 includes a conveying belt 10 for allowing the document sheet which is arrayed by the aligning roller 9 to be conveyed along the document glass 2 and a discharging system conveying path 11 for allowing the document sheet which is conveyed from the conveying belt 10 to be discharged.

That portion of the conveying belt 10 facing the document glass 10 is urged by urging rollers 16a to 16*c* from its inner side toward the document glass. The conveying belt 10 is trained between a drive roller 17 and a driven roller 18. The urging rollers 16*a*, . . . , 16*c* are arranged, as a plurality of rollers, at predetermined intervals over the feeding direction of the document.

A discharge sensor 12 for detecting the document sheet and sheet discharge roller 13 for discharging the document sheet are arranged in the discharge system conveying path 11. A document discharge section 14 is provided at the upper surface section of the automatic document feeding apparatus 3 to receive the document sheet discharged from the sheet discharge roller 13.

Figure 2:
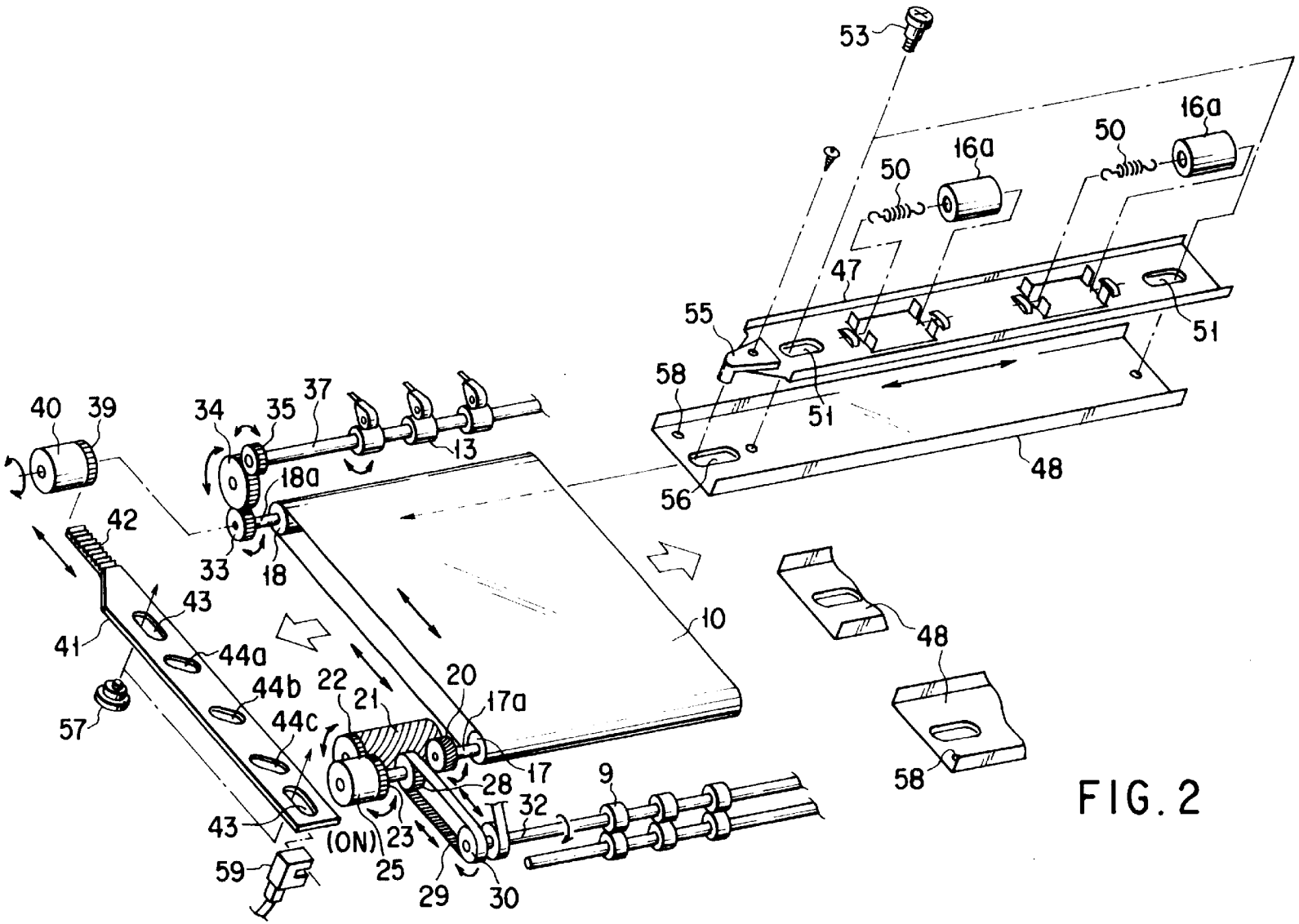
FIG. 2 is an exploded perspective view showing a moving mechanism of urging rollers for urging a conveying belt.

FIG. 2 is a perspective, exploded view showing a moving mechanism 19 of the urging rollers 16*a*, . . . , 16*c*.

A drive motor 26 (shown in FIG. 3) is connected to a drive roller shaft 17*a* of the conveying belt 10 through a gear train 24 comprising first to fourth gears 20 to 23 and clutch 25. A shaft 32 of the aligning roller 9 is connected to the fourth gear 23 through a fifth gear 28, timing belt 29 and sixth gear 30. A shaft 37 of the sheet discharge roller 13 is connected to a driven roller shaft 18*a* of the conveying belt 10 through seventh to ninth gears 33 to 35.

A pinion 39 and clutch 40 are connected to the driven roller shaft 18*a* of the conveying belt 10. A rack section 42 is provided on one end portion of a slider 41 and is in mesh with the pinion 39. Elongated holes 43 are provided one at each end portion of the slider 41 along a longitudinal direction of the slider. A plurality of (three) oblique guide holes 44*a*, . . . , 44*c* are provided between these elongated holes 43 and 43 such that these guide holes 44*a* to 44*c* are obliquely formed relative to the longitudinal direction (moving direction) of the slider 41.

The pushing rollers 16*a*, . . . , 16*c* are retained in two units on a retaining member 47 in a direction perpendicular to the document conveying direction. The retaining member 47 is so supported on a support member 48 as to be slidable in a direction perpendicular to the document conveying direction.

The urging rollers 16*a* (. . . , 16*c*) is retained by urging springs 50 on the retaining member 47. Elongated holes 51, 51 are provided one at each end portion of the retaining member 48. And stepped screws 53, 53 are inserted into the elongated holes 51, 51 and the threaded into the end portions of the support member 48. That is, the retaining member 47 is so mounted on the support member 48 as to be slidable along its longitudinal direction.

A projection member 55 is provided on one end of the retaining member 1 and inserted into the oblique guide hole 44*a* (. . . , 44*c*) of the slider 41 through an elongated hole 56 in one end portion of the support member 48.

The above-mentioned slider 41 is slidably coupled between one-end side portions of the support members 48, 48. That is, the slider 41 is slidably and detachably mounted by threadably inserting stepped screws 57, 57 from below the elongated holes 43, 43 into screw holes 58, 58 of the support members 48, 48.

A sensor 59 is provided in the other end direction of the slider 41 to detect the position of the slider 41.

Figure 3:
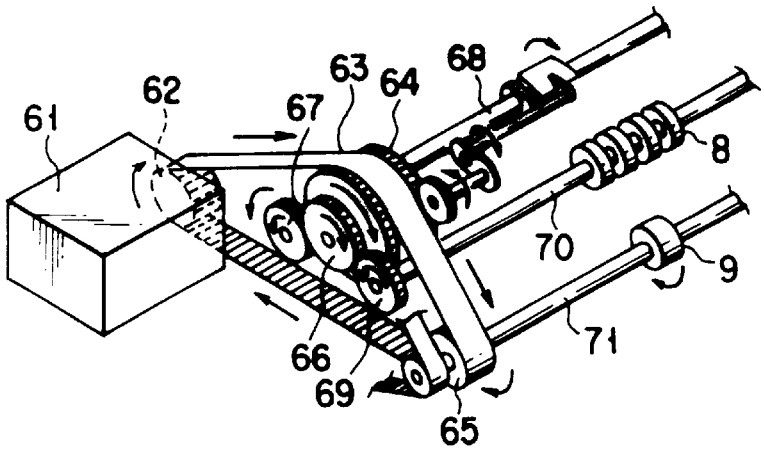
FIG. 3 is a perspective view showing a drive system of the conveying belt.
Figure 4:
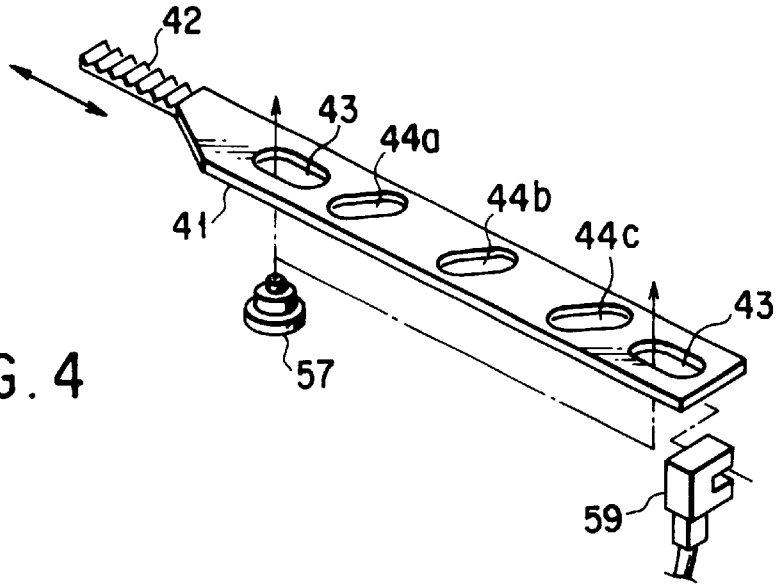
FIG. 4 is a perspective view showing a practical form of a slider of the first embodiment.

FIG. 3 is a perspective view showing a drive system of a document supply section.

Reference numeral 61 in FIG. 3 shows a drive motor. Gears 64, 65 are coupled to a drive gear 62 of the drive motor 61 through a drive belt 63. A shaft 58 of the pick-up roller 6 is connected to a gear 64 through gears 66, 67, a shaft 70 of the sheet supply roller 8 is connected to the gear 66 through the gear 69, and a shaft 71 of the aligning roller 9 is connected to the gear 65.

The automatic document feeding operation will be explained below.

With the drive motor 61 rotated, the gears 64, 65 are rotated through the drive belt 63. With the rotation of the gear 64, the pick-up roller 6 is rotated through the gear 67 and shaft 68 and the sheet supply roller 8 is rotated through the gear 69 and shaft 70. With the rotation of the gear 65, the aligning roller 9 is rotated through the shaft 71.

With the rotation of the pick-up roller 6, the document sheet on the document sheet rest 5 is picked up. In this case, the document sheets are supplied one by one through the rotation of the sheet supply roller 8 and, with the rotation of the aligning roller 9, the document sheet is arrayed and sent out onto the conveying belt 10.

Further, with the rotation of the aligning roller 9, the drive roller shaft 17*a* of the conveying belt 10 is rotated through the gear 30, timing belt 29, gear 28, gear 23, gear 22, gear 21 and gear 20 and the conveying belt 10 is run. The conveying belt 10 is urged by the urging rollers 16*a*, . . . , 16*c* from its inner side and, while pushing the document sheet toward the document glass 21, conveys the document sheet and feeds the document sheet onto the document glass 2. When the document sheet is sent to a predetermined position, the clutch 25 is released and a power transmission is stopped and the document sheet is stopped. The stopped document has its image information read out by an optical system not shown. After the image information is read out from the document sheet, the clutch 25 is coupled and again the conveying belt 10 is run to allow the document sheet to be sent out and discharged through the sheet discharge roller 13 to the sheet discharge section 14.

Incidentally, the positions of the above-mentioned urging rollers 16*a*, . . . , 16*c* are periodically changed to prevent the conveying belt 10 being soiled and worn.

Then the operation of moving the urging rollers 16*a*, . . . , 16*c* will be explained below.

Figure 5:
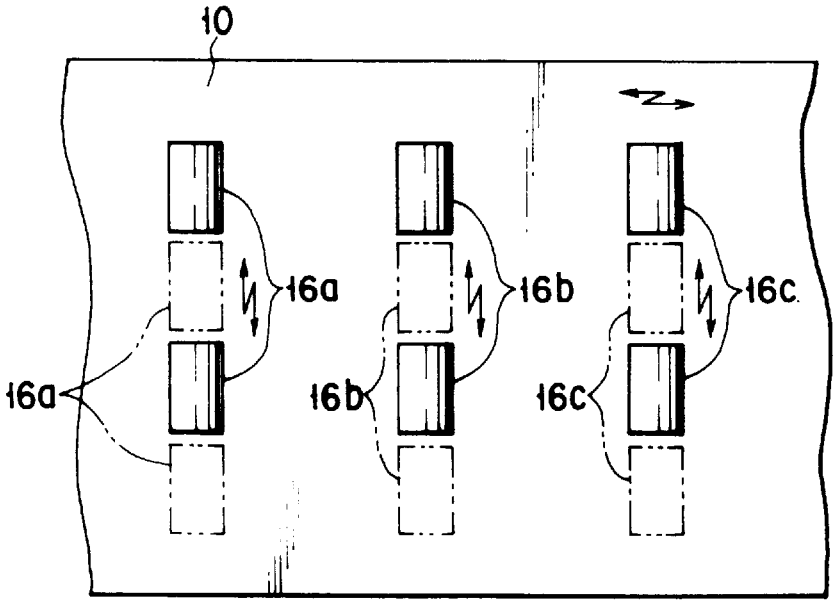
FIG. 5 is a plan view showing a moving state of urging rollers.

When the clutch 40 is coupled with the conveying belt 10 in a running state, a rotation force of a driven roller shaft 18*a* of the conveying belt 10 is transmitted to the pinion 39 and the pinions 39 is rotated. By this rotation, the slider 41 is moved n the conveying direction of the document through the rack section 42. By this movement, the projection member 55 of the retaining member 47 is guided in the oblique guide hole 44*a* (. . . , 44*c*) to allow the retaining member 47 to be moved in a direction perpendicular to the conveying direction of the document sheet. And the urging-roller 16*a* (. . . , 16*c*) is moved in the same direction. By the movement of this urging roller 16*a* (. . . , 16*c*), the position of the contacting of the urging roller 16*a* (16*c*) with the conveying belt 10 is made variable as shown, for example, in FIG. 5.

When the slider 41 is moved by a predetermined amount, the sensor 59 detects it. Upon this detection, the clutch 40 is released and the retaining member 47 stops its movement and the movement of the urging roller 16*a* (. . . , 16*c*) is stopped.

As a condition under which the urging roller 16 (. . . , 16*c*) is moved, for example, an initializing operation is done each time the number of document sheets sent reaches a predetermined sheet number and, by doing so, the movement is started.

That is, whether or not the slider 41 is detected by the sensor 25 is acknowledged. If it is detected, the slider 41 is moved.

If it is not detected, the conveying belt 10 is reverse-rotated and the clutch 40 is coupled and the slider 41 is moved until the sensor 25 detects the slider 41.

According to the present embodiment, since the urging rollers 16*a*, . . . , 16*c* of the conveying belt 10 are moved in the direction perpendicular to the conveying direction of the document, it is possible to change the urging position of the conveying belt 10 by the urging rollers 16*a*, . . . , 16*c*. As a result, it is possible to alleviate the wear and soiling of the conveying belt 10 and extend the life of the conveying belt.

Figure 6:
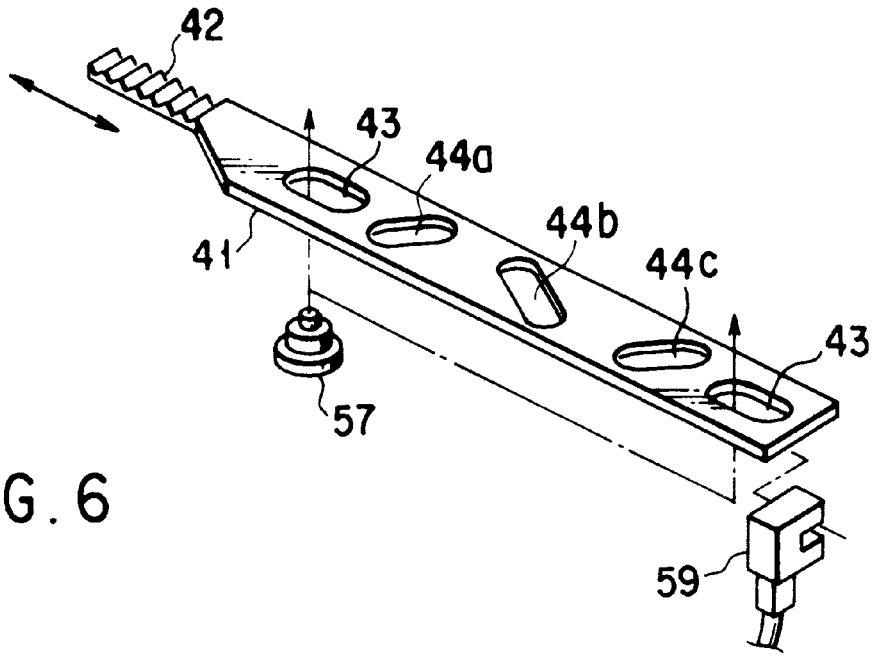
FIG. 6 is a perspective view showing a second practical form of a slider of a second embodiment.
Figure 7:
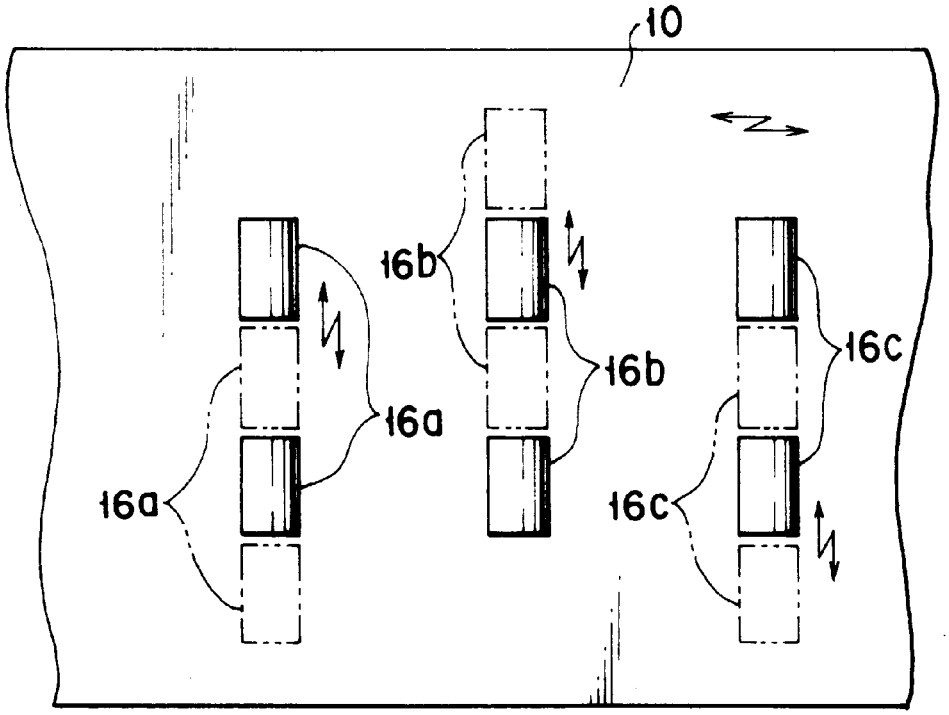
FIG. 7 is a plan view showing a moving state of urging rollers.

FIG. 6 shows a second embodiment of the slider.

Although, in the above-mentioned embodiment, the guide holes 44*a*, . . . , 44*c* are formed in the slider 41 in the same oblique direction, the second embodiment is such that, out of three guide holes 44*a*, . . . , 44*c*, the middle guide hole 44*b* are formed in a "back-slash" direction relative to the other oblique guide holes 44*a* and 44*c*.

According to this embodiment, at a time of moving the slider 41, the moving direction of the middle urging roller 16*b* is reverse to those of the remaining oblique rollers 16*a*, 16*c* and it is possible to shift the contacting position of the middle urging roller relative to the conveying belt 10.

Figure 8:
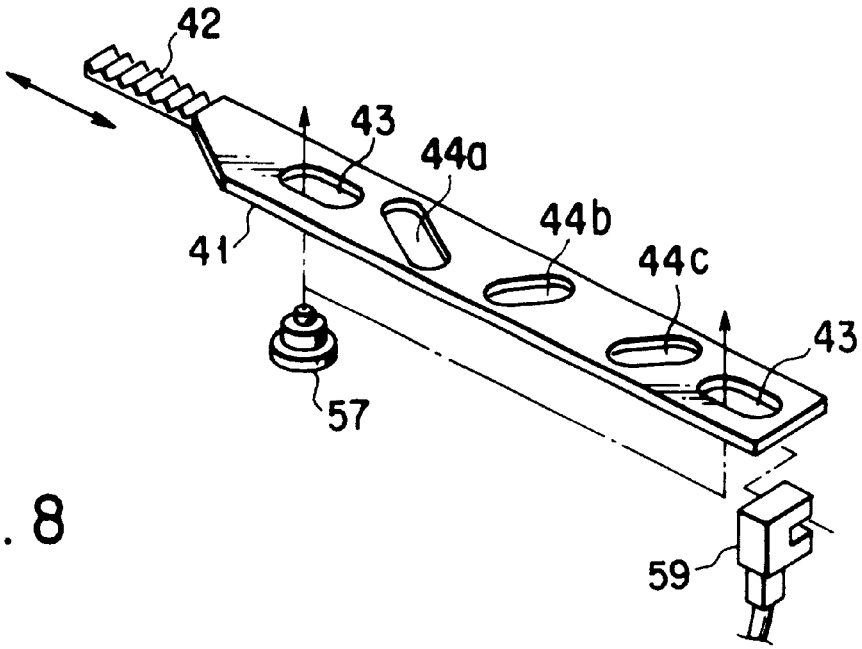
FIG. 8 is a perspective view showing a third practical form of a slider of a third embodiment.

FIG. 8 shows a third embodiment of the slider.

In this embodiment, out of three oblique guide holes 44*a*, . . . , 44*c*, the leftmost oblique guide hole 44*a* is formed in a "back-slash" direction relative to the other oblique guide holes 44*b*, 44*c*.

Figure 9:
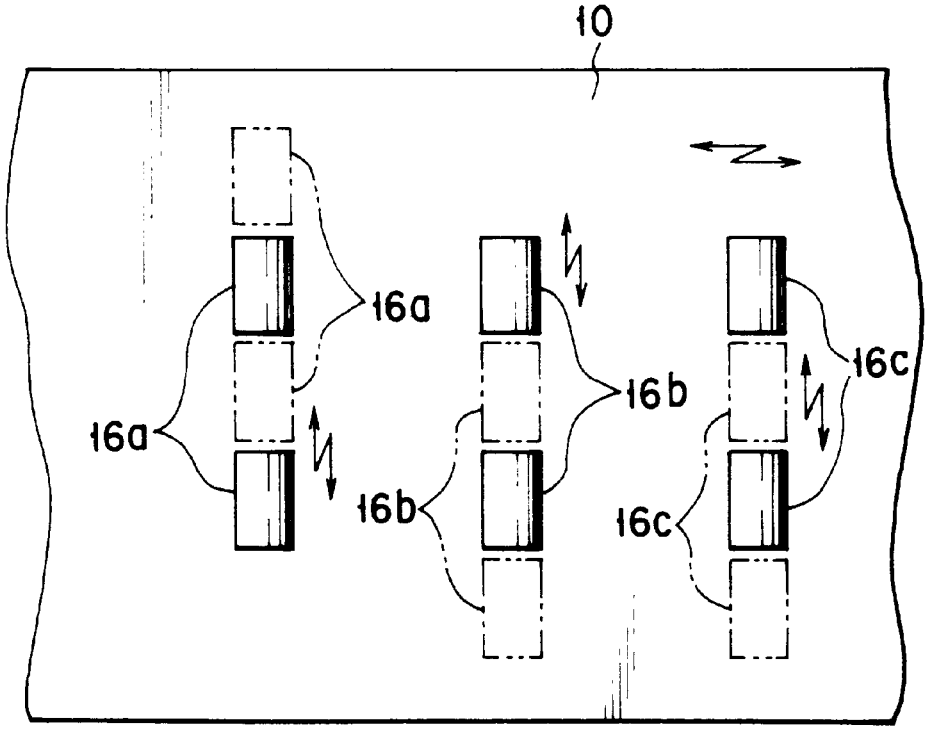
FIG. 9 is a plan view showing a moving state of urging rollers.

According to this third embodiment, at a time of moving the slider 41, as shown in FIG. 9, the moving direction of a leftmost urging roller 16*a* is reverse to those of the other urging rollers 16*b*, 16*c* and it is possible to shift the contacting position of that urging roller relative to the conveying belt 10 in a reverse direction.

That is, the moving amount and moving direction of the urging roller 16 are determined by the oblique angles and oblique directions of the oblique guide holes 44*a*, . . . , 44*c*.

Further, the slider is detachably mounted on the support members 48, 48 and it is possible to change a slider having oblique guide holes of desired oblique angles and oblique directions.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An automatic document feeding apparatus comprising:

a document rest for allowing a document to be placed thereon;

a conveying belt for conveying the document onto the document rest;

an urging roller for urging the conveying belt toward the document rest;

a retaining member for retaining the urging roller;

a support member for supporting the retaining member in a way to be slidable in a direction intersecting with the conveying direction of the document;

a projection provided at one end of the retaining member;

a slider mounted on the support member to slide along a conveying direction of the document;

an oblique guide hole formed in the slider in a way to be made oblique with respect to the slide direction and slidably inserting the projection of the retaining member therein; and moving means which, by causing the slider to slide in the conveying direction of the document, moves the projection of the retaining member along the oblique guide hole to allow the urging roller to move in a direction intersecting with the conveying direction of the document.

2. An automatic document feeding apparatus according to claim 1, wherein the slider is detachably mounted on the support member.

3. An automatic document feeding apparatus according to claim 1, wherein, as the urging roller, a plurality of rollers are provided over the conveying direction of the document and, as the oblique guide hole in the slider, a plurality of oblique guide holes are provided to correspond to the number of the urging rollers.

4. An automatic document feeding apparatus according to claim 3, wherein the plurality of oblique guide holes are made oblique in the same direction.

5. An automatic document feeding apparatus according to claim 3, wherein the plurality of oblique guide holes are different in an oblique direction.

* * * * *